US007776257B2

(12) United States Patent
Grauman et al.

(10) Patent No.: US 7,776,257 B2
(45) Date of Patent: Aug. 17, 2010

(54) TITANIUM ALLOY HAVING IMPROVED CORROSION RESISTANCE AND STRENGTH

(75) Inventors: James S. Grauman, Henderson, NV (US); Stephen P. Fox, Henderson, NV (US); Stacey L. Nyakana, Henderson, NV (US)

(73) Assignee: Titanium Metals Corporation, Dallas, TX (US)

( * ) Notice: Subject to any disclaimer, the term of this patent is extended or adjusted under 35 U.S.C. 154(b) by 0 days.

(21) Appl. No.: 12/341,378

(22) Filed: Dec. 22, 2008

(65) Prior Publication Data

US 2009/0123326 A1 May 14, 2009

Related U.S. Application Data

(63) Continuation of application No. 11/512,348, filed on Aug. 30, 2006, now abandoned.

(60) Provisional application No. 60/717,761, filed on Sep. 19, 2005.

(51) Int. Cl.
*C22C 14/00* (2006.01)

(52) U.S. Cl. ..... 420/417; 148/421

(58) Field of Classification Search ..... 420/417
See application file for complete search history.

(56) References Cited

U.S. PATENT DOCUMENTS

| | | | | |
|---|---|---|---|---|
| 2,786,756 | A * | 3/1957 | Swazy et al. | 420/418 |
| 4,420,460 | A * | 12/1983 | Crossley | 420/417 |
| 5,141,574 | A * | 8/1992 | Takahashi et al. | 148/206 |
| 5,613,849 | A | 3/1997 | Tanaka et al. | |
| 6,306,196 | B1 | 10/2001 | Kate et al. | |

FOREIGN PATENT DOCUMENTS

| | | |
|---|---|---|
| EP | 0820735 | 1/1998 |
| JP | 64-68437 A | 3/1989 |
| JP | 01068437 | 3/1989 |
| JP | 1222026 | 9/1989 |
| JP | 2001-049304 | 2/2001 |
| SU | 834183 | 5/1981 |

OTHER PUBLICATIONS

Machine Translation of Japanese Publication No. 09-302429, *Titanium Alloy for Living Body*, published Nov. 25, 1997.
Milton Stern, et al. publication entitled "The Influence of Noble Metal Alloy Additions on the Electrochemical and Corrosion Behavior of Titanium," J. Electrochem. Soc., vol. 106, Issue 9, pp. 759-764 (1959).
International Preliminary Report on Patentability issued Mar. 26, 2008 for International Application No. PCT/US2006/035867.
Written Opinion of the International Searching Authority issued for International Application No. PCT/US2006/035867.
International Search Report dated Feb. 28, 2007 for PCT/US2006/035867, filed Sep. 14, 2006.
Hideto Oyama et al., "A new alpha-beta alloy, Ti-4.5Al-4Cr-0.5Fe-0.2C, solution hardened by ultra high content of carbon," Materials Science Forum, vols. 426-432 (2003), pp. 713-718, Trans. Tech. Publications, Switzerland.
Molchanova E.K. in "Atlas of titanium alloy state diagrams," Moscow, Mashinostroyenie, 1964, diagrams appearing on pp. 379-382; cited in an Office Action mailed Apr. 15, 2010 in a related Russian Patent application (No. 2008115445).

* cited by examiner

*Primary Examiner*—George Wyszomierski
*Assistant Examiner*—Tima M McGuthry-Banks
(74) *Attorney, Agent, or Firm*—Locke Lord Bissell & Liddell, LLP

(57) ABSTRACT

A titanium alloy containing carbon with and without addition of silicon exhibiting improved corrosion resistance and mechanical strength as compared to commercially pure ASTM grade 2 titanium or PGM-alloyed ASTM grade 7 titanium.

8 Claims, 2 Drawing Sheets

Ti-1C

Ti-2C

TITANIUM ALLOY HAVING IMPROVED CORROSION RESISTANCE AND STRENGTH

CROSS REFERENCE TO RELATED APPLICATIONS

This application is a continuation of U.S. Non-Provisional patent application Ser. No. 11/512,348 filed Aug. 30, 2006, now abandoned, which claims priority to U.S. Provisional Application Ser. No. 60/717,761, filed Sep. 19, 2005, both of which are incorporated by reference herein in their entirety.

DESCRIPTION OF THE INVENTION

1. Field of the Invention

This invention relates to a new titanium alloy wherein improved corrosion resistance and strength is achieved by the use of up to 4 weight percent carbon as an alloying agent to the base titanium or titanium alloy thereof.

2. Description of the Prior Art

Titanium, being a reactive metal, relies on the formation and stability of a surface oxide film for corrosion resistance. Under stable conditions, titanium can demonstrate remarkable corrosion resistant behavior. The reverse is also true, however, in that when the film is destabilized, extremely high corrosion rates may result. These conditions of instability are generally at the two extremes of the pH scale. Strongly acidic or alkaline solutions can create instability in the titanium oxide film.

Typically, in accordance with prior art practice, when using titanium in an area of uncertain oxide film stability, alloying elements have been added to the titanium to enhance the oxide film stability, thus increasing its effective usefulness at the pH extremes. This practice has proven most effective for the acid end of the pH scale, where alloying can increase the stability of the oxide film by up to 2 pH units or more. Since pH is measured on a logarithmic scale, this translates to a potential increase in passivity of more than 100 fold in aggressive acid conditions, such as boiling HCl. Several alloying elements have shown varying degrees of success in this regard, such as molybdenum, nickel, tantalum, niobium and the precious metals. Of this group, the platinum group metals (PGM) offer far and away the most effective protection against corrosion. The platinum group metals are platinum, palladium, ruthenium, rhodium, iridium and osmium.

Stern et al. demonstrated this in 1959 in a paper titled "The Influence of Noble Metal Alloy Additions on the Electrochemical and Corrosion Behavior of Titanium". They found that as little as 0.15% Pd or Pt alloying additions greatly enhanced the stability of the oxide film on titanium, and thus the corrosion resistance, in hot reducing acid medium. Consequently, for many years the ASTM grade 7 titanium (Ti-0.15Pd) has been the standard material chosen for use in severe corrosive conditions where unalloyed titanium is subject to corrosion. More recently, ASTM grade 16 (Ti-0.05Pd) has been used as a direct replacement for grade 7 because it is more economical and provides a level of corrosion resistance close to that of grade 7. Thus, it tends to be considered equivalent in less drastic corrosion applications.

The mechanism of protection afforded by platinum group metal additions to titanium is one of increased cathodic depolarization. The platinum group metals afford a much lower hydrogen overvoltage in acidic media, thereby increasing the kinetics of the cathodic portion of the electrochemical reaction. This increased kinetics translates to a change in the slope of the cathodic half reaction, leading to a more noble corrosion potential for the titanium. The active/passive anodic behavior of titanium allows for a small shift in corrosion potential (polarization) to effect a large change in the corrosion rate.

The problem with alloying titanium with any of the elements listed above is the added cost of doing so. Each of the elements listed above are more costly than titanium, thus producing a more costly product in order to achieve the desired enhanced corrosion protection. The cost for adding a small amount of palladium (0.15%) can literally double or triple the cost of the material (depending on the prevailing price of palladium and titanium).

Although the above-described prior art practices are effective for enhancing the corrosion resistance of titanium in severe corrosive conditions, alloying additions of precious metals and especially the platinum group metals are extremely expensive and thus of limited viability to the end user. An alloy with the performance of ASTM grade 7, but with a cost more akin to commercially pure ASTM grade 2 titanium (Ti-0.12O), would be of great benefit to the end users of titanium.

Additionally, commercially pure titanium grade 2 is most commonly used for chemical process and marine applications. ASTM grade 2 can be easily formed and fabricated. This grade of titanium offers the highest strength for a commercially pure grade while maintaining resistance to a particular form of corrosion called stress corrosion cracking (SCC). ASTM grades 3 and 4 titanium (with elevated oxygen levels, as compared to grade 2, for producing added strength), while desirable from purely the strength standpoint, cannot be used due to their propensity for SCC in chloride environments, such as sea water, due to these elevated oxygen levels.

Traditionally, oxygen has been used as the main strengthening agent in commercially pure titanium grades 1-4. However, when oxygen levels exceed 0.20 wt. %, susceptibility for stress corrosion cracking becomes quite high. Thus, despite their desirable strength levels, which could lead to lighter weight components, grades 3 and 4, with oxygen levels above the 0.20% threshold, are typically avoided by end users when chloride media will be encountered.

Thus, an alloy with all of the desirable characteristics of commercially pure grade 2, such as formability and SCC resistance, and the higher strength of commercially pure grade 3 or 4 titanium, would be very valuable to many titanium users, such as the chemical process and marine or Naval markets. Use of this higher strength, SCC resistant alloy would allow for reduced gages, leading to lighter weight components and lower costs since less titanium is required.

SUMMARY OF THE INVENTION

The invention of the instant application provides, in place of alloying with expensive elements, using inexpensive alloying elements which achieve greatly improved corrosion resistance of titanium subjected to severe corrosive applications and improved mechanical strength, as compared to commercially pure ASTM grade 2 titanium, and thus is advantageous in this regard when compared to the prior art practices discussed above. In addition, the invention affords an alloy with equivalent corrosion properties, improved mechanical properties, and greatly reduced cost as compared to PGM-alloyed titanium, such as ASTM grade 7.

In accordance with the invention, it has been determined that a titanium alloy exhibiting improved corrosion resistance, as compared to commercially pure ASTM grade 2, may be achieved by using carbon as the primary alloying element. The alloy so described may be alloyed with carbon within the range of 0.2 to 4 weight percent, with a preferred range of 0.5 to 2.0 weight percent. In accordance with the invention, an alloy so produced with a preferred range of carbon addition offers improvements in both corrosion resistance and strength as compared to unalloyed titanium (ASTM grades 1-4) and PGM-alloyed titanium (ASTM grades 7 and 16). The aforementioned preferred range allows for retention of cold formability of the alloy, which is desirable for ease of fabrication. In addition, the alloy can be welded with little or no degradation in corrosion behavior. This alloy can also contain from 0.1-0.5 weight percent silicon to improve the mechanical strength to an even greater extent. The said alloy will also be capable of replacing ASTM grades 3 and 4 for use in chloride containing environments without the potential for stress corrosion cracking.

DESCRIPTION OF THE PREFERRED EMBODIMENTS AND SPECIFIC EXAMPLES

Figure 1:
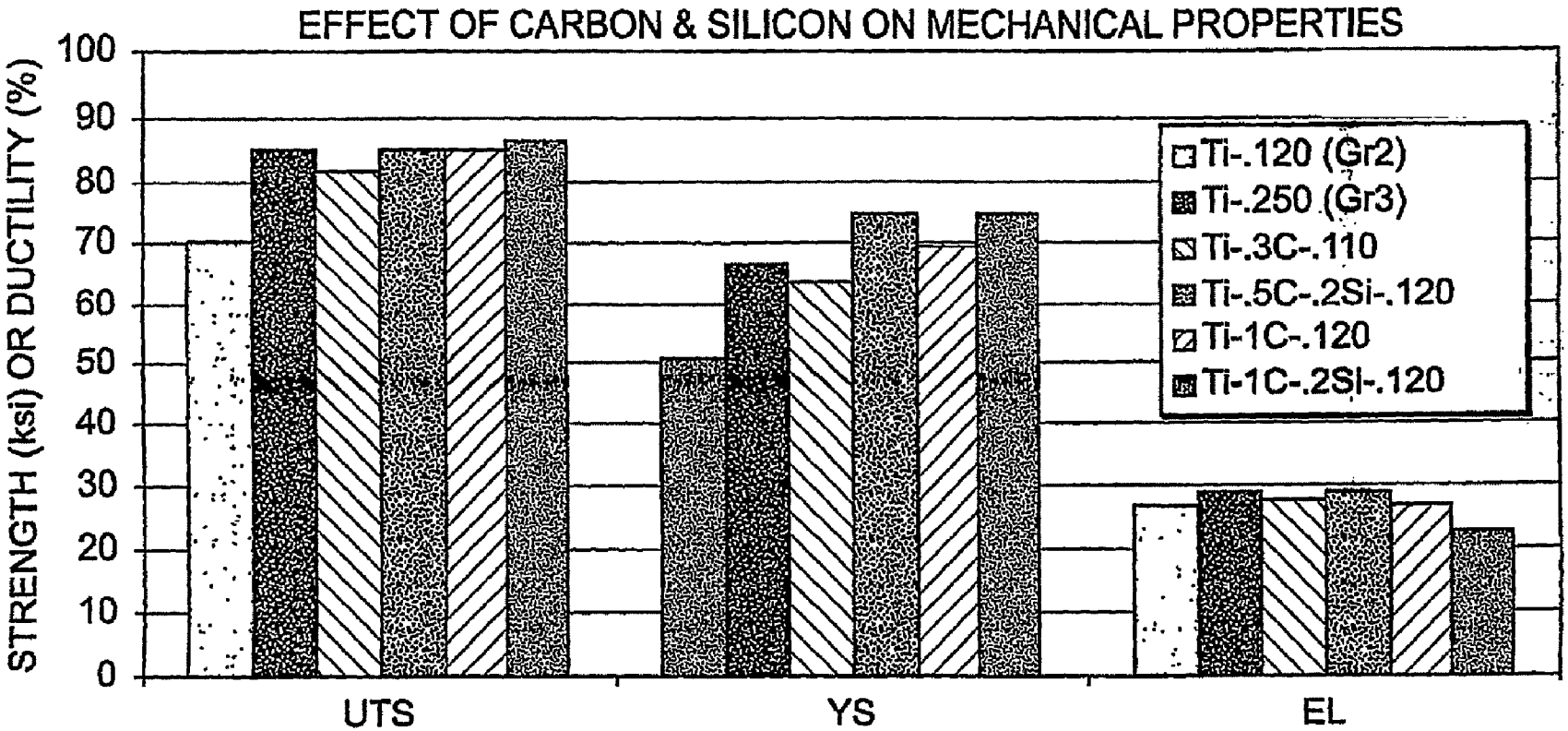
FIG. 1 is a bar graph showing the effect of carbon and silicon on mechanical properties.

In experimental work leading to the invention, mechanical property testing was performed with titanium alloys having varying carbon levels with excellent results. As shown in FIG. 1, alloying with small levels of carbon can produce up to 40% increases in mechanical strength, yielding alloys equal to or greater in strength than typical ASTM grade 3.

Additionally, as shown in FIG. 1, alloying with carbon and silicon can produce even greater increases in yield strength as compared to commercially pure titanium grade 2, yielding alloys greater in strength than ASTM grade 3.

In experimental work leading to the invention, general corrosion testing was also performed with titanium alloys having varying carbon levels with excellent results. As shown in Tables 1 and 2, the practice of the invention can be much more effective than unalloyed titanium. As seen in Table 2, alloys with 2 weight percent carbon offer equivalent corrosion resistance to ASTM grade 7 (Ti-0.15Pd) titanium, which is considered the most corrosion resistant titanium alloy available commercially.

Also, Table 2 compares the corrosion rates for several of the carbon alloys containing a weld. As demonstrated by the results, there is very little degradation that occurs when these carbon alloys are welded, which is an important consideration in terms of any titanium vessel, heat exchanger, or other component fabrication where welds are present.

TABLE 1

Corrosion Rates for Ti—C Alloys in Boiling Hydrochloric Acid

| HCl | Corrosion Rates in mpy | | | | |
|---|---|---|---|---|---|
| Conc. | Ti—0.016C* | Ti—.16C | Ti—.32C | Ti—1C | Ti—1.5C |
| 0.1 | 0 | 0 | 0 | 0 | |
| 0.3 | 11.1 | 3.7 | 0 | 0 | |
| 0.5 | 27.1 | 11 | 4.3 | 0 | |
| 1.0 | 61.9 | 29.5 | 12.5 | 0.2 | |
| 1.5 | 112 | 50 | 30 | 0.2 | 0.5 |
| 2.0 | | | | 0.7 | |
| 2.5 | | | | 1.6 | |
| 3.0 | | | | 2.5 | 1.2 |

TABLE 1-continued

Corrosion Rates for Ti—C Alloys in Boiling Hydrochloric Acid

| HCl | Corrosion Rates in mpy | | | | |
|---|---|---|---|---|---|
| Conc. | Ti—0.016C* | Ti—.16C | Ti—.32C | Ti—1C | Ti—1.5C |
| 3.5 | | | | 208 | |
| 4.0 | | | | | 2.4 |

*Note:
Ti—0.016C is equivalent to ASTM Grade 2 (unalloyed) titanium.

TABLE 2

Corrosion Rate Comparisons in Boiling Hydrochloric Acid

| Test Material | Corrosion Rate @ 1% HCl | Corrosion Rate @ 1.5% HCl | Corrosion Rate @ 3% HCl | Corrosion Rate @ 5% HCl |
|---|---|---|---|---|
| ASTM Grade 2 | 60 | — | 250 | 850 |
| ASTM Grade 7 | 0.4 | — | 1.3 | 4.5 |
| Ti—0.3C | 12.5 | — | 102 | — |
| Ti—1.0C | 0.2 | — | 2.5 | 430 |
| Ti—1.5C | — | 0.4 (1.5%) | 1.2 | 5.1 |
| Ti—1.5C (weld) | — | — | 1.2 | 12 |
| Ti—2.0C | — | 0.4 (1.5%) | 1.1 | 4.0 |
| Ti—2.0C (weld) | — | — | 1.2 | 9 |
| Ti—3.0C | — | 0.5 (1.5%) | 1.3 | 3.6 |

Note:
Corrosion rates are all listed in mpy (mils/yr)

Likewise, in the practice of the invention corrosion rates can be reduced in oxidizing acids as well. This is illustrated in Table 3 for concentrated nitric acid. In this instance, the titanium alloyed with carbon performs much better than ASTM grade 7 (Ti-PGM alloy), which offers no additional protection over commercially pure grade 2 in strongly oxidizing acid. The carbon alloying reduces the corrosion rates in nitric acid by 50%, with as little as a 0.15 weight percent addition.

TABLE 3

Corrosion Rates in Nitric Acid

| Test Material | Solution | Corrosion Rate (mpy) | Comments |
|---|---|---|---|
| ASTM Grade 2 | 40% @ Boiling | 24 | From data archive |
| ASTM Grade 7 | 40% @ Boiling | 25 | From data archive |
| Ti—0.016C (equivalent to Gr 2) | 40% @ Boiling | 27 | 96 Hr. Exposure |
| Ti—0.15C | 40% @ Boiling | 12 | 96 Hr. Exposure |
| Ti—0.3C | 40% @ Boiling | 10 | 96 Hr. Exposure |
| Ti—1.0C | 40% @ Boiling | 12 | 96 Hr. Exposure |

In experimental work leading to the invention it was also determined through crevice corrosion testing that the titanium metal within a crevice can be very effectively protected by application of the alloy of the invention. The titanium so alloyed with carbon offers improved resistance to crevice corrosion as compared to unalloyed (ASTM Grade 2) titanium. Results are shown in Table 4.

TABLE 4

Crevice Corrosion Results

| Test Material | Solution | % of Surfaces Attacked | Severity of Corrosion |
|---|---|---|---|
| ASTM Grade 2 | 5% NaCl, pH 3 | 50 | Moderate Attack |
| ASTM Grade 7 | 5% NaCl, pH 3 | 0 | No Attack |
| Ti—0.5C | 5% NaCl, pH 3 | 0 | No Attack |
| Ti—1.0C | 5% NaCl, pH 3 | 0 | No Attack |
| ASTM Grade 2 | 5% NaCl, pH 1 | 100 | Severe Attack |
| ASTM Grade 7 | 5% NaCl, pH 1 | 0 | No Attack |
| Ti—0.5C | 5% NaCl, pH 1 | 10 | Slight Attack |
| Ti—1.0C | 5% NaCl, pH 1 | 0 | No Attack |

Stress corrosion tests leading to the invention were performed on the alloy with excellent results. The alloy exhibited no evidence of SCC in U-bend testing and as shown in Table 5, exhibited excellent TTF (Time to Failure) ratios in slow strain rate (SSR) testing, which is defined as the ratio of the time to failure in air to the time to failure in the environment, which in this case was sea water. A ratio above 90% is considered to be indicative of resistance to SCC.

TABLE 5

Stress Corrosion Testing of Ti—C Alloys

| Test Material | Environment | TTF (Hrs) | TTF Ratio |
|---|---|---|---|
| Ti—0.3C | Air | 91.5 | NA |
| Ti—0.3C | Sea Water | 94.5 | 103% |

It is well understood that the corrosion resistance of titanium is dependent on the stability of the oxide film. The oxide film can be destabilized in aggressive acid conditions resulting in very high corrosion rates. The addition of alloying elements such as palladium or other PGM's tend to shift the hydrogen overvoltage on the titanium surface resulting in more noble potentials for the metal in these types of corrosive environments. This noble shift in the corrosion potential of the metal affords a dramatic reduction in the corrosion rate. In addition, it is possible that the noble metal sites within the titanium oxide film matrix act to galvanically protect the remainder of the titanium surface. This has been shown dramatically through the use of appliqués on the surface of titanium, where the ability of the titanium to be easily polarized allowed large surface areas to be protected by very small area ratios of a precious metal.

It is also well known that carbon is a very noble element, being very close to platinum on a galvanic series. Carbon is normally considered an interstitial element in titanium, lying within the crystallographic framework of the titanium, just like oxygen. Interstitial elements can dramatically increase the strength of titanium with very small incremental additions. Oxygen can be added as a strengthener to titanium up to levels of 0.4 weight percent or more until the titanium crystal lattice is so strained that the titanium loses ductility and becomes susceptible to stress corrosion cracking (SCC).

Figure 2:
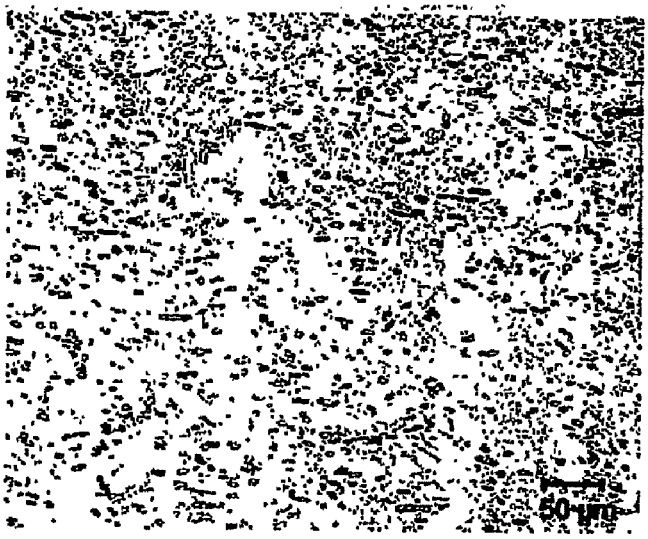
FIG. 2 is a photomicrograph at a magnification of 200× for a Ti-1C alloy.
Figure 3:
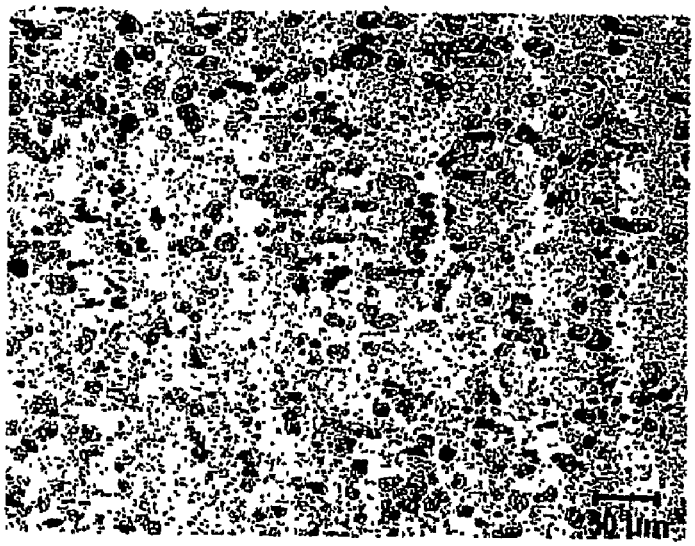
FIG. 3 is a photomicrograph similar to FIG. 2 for a Ti-2C alloy.

However, in the case of carbon, it appears that once the carbon level exceeds some nominal concentration, such as 0.1 weight percent or less, the element then becomes deposited within the titanium matrix much like palladium. This can be seen in the photomicrographs, FIGS. 2 and 3, where "islands" or pockets of carbon or intermetallic carbon compounds are easily observed. This explains why the strength levels rise rapidly as the carbon is first introduced and the carbon goes to interstitial sites, but the strengths quickly level off as additional carbon is added and it goes into the matrix, where strengthening occurs much more slowly. Thus, the crystal lattice is not strained as with increasing oxygen levels and the alloy can maintain good ductility and remain resistant to SCC.

Bend tests are performed on titanium sheet as one indication of ductility. ASTM grade 2 titanium must pass a 4T bend, where T indicates the gage of the sheet. In our studies in accordance with the invention, all titanium-carbon alloys containing up to 2 wt % carbon, passed the 4T bend criteria, indicating that the invention alloy would be capable of similar cold working and fabrication characteristics as ASTM grade 2 titanium.

In addition, it is imperative that an alloy intended to be used in the chemical process industry be produced via cold rolling into large coils. This is the most economical method of producing titanium thin sheet or strip. In the course of this study a series of cold rolling trials were performed on the invention alloys. Typically, a titanium alloy must be able to be cold rolled 45% in order to be considered strip producible. All of the titanium-carbon alloys up to and including 2 wt. % could be cold rolled to 70%, well above the necessary 45%. Thus, the invention alloy will be capable of being produced into cold rolled strip.

It is presumed that the carbon residing in the titanium matrix is responsible for the increased corrosion resistance. Thus, these "islands" of carbon or intermetallic carbon act to ennobelize the corrosion potential, reducing the corrosion rates significantly. These noble sites also act to galvanically protect the titanium surface.

The cost benefits of the invention alloy over conventional corrosion enhanced titanium alloys are huge. Specifically, at any weight percent addition, the incremental cost of this alloy over the base cost of the titanium is negligible and, in fact, may be lower than titanium grade 2 since the raw material costs are lower for carbon than for titanium sponge. By contrast, the incremental cost of grade 7, which is titanium alloyed with 0.15% palladium, over grade 2 commercially pure titanium, is on the order of $15/lb. Yet, both would appear to offer the same corrosion resistance in boiling HCl media and the invention alloy appears to offer improved corrosion performance in oxidizing acid media such as nitric.

The invention also provides significant advantages with respect to delivery and availability of the corrosion resistant material. Specifically, users do not normally inventory titanium alloys containing a PGM due to the added cost of inventorying these high cost metals. Thus, these grades tend to be less available than standard grades of titanium that do not contain an alloyed PGM. Consequently, delivery times tend to be longer since manufacturers are generally required to work these melts into their melting schedule as time permits. Whereas, normal grades of titanium (without a precious metal addition) are in production and inventoried on a routine basis and additional melts may be added without time delays.

By inference, it may be seen that similar benefits as demonstrated in the instant invention could well be obtained by carbon additions to any existing titanium alloy.

The term "titanium" as used herein in the specification and claims refers to elemental titanium, commercially pure titanium and titanium base alloys. The term "corrosion" as used herein in the specification and claims is defined as the chemical or electrochemical reaction between a material, usually a metal, and its environment that produces a deterioration of the material and its properties. All percentages are in "weight percent".

What is claimed is:

1. A titanium alloy having improved corrosion resistance and strength consisting essentially of titanium, carbon and oxygen, wherein said carbon comprises 0.5 to 1.5 weight percent of said titanium alloy and said oxygen comprises up to 0.2 weight percent of said titanium alloy.

2. The titanium alloy of claim 1 wherein said carbon comprises 1.0 to 1.5 weight percent of said titanium alloy.

3. A cold rolled product comprising the titanium alloy of claim 1.

4. A cold rolled product comprising the titanium alloy of claim 2.

5. A sheet product comprising the titanium alloy of claim 1.

6. A sheet product comprising the titanium alloy of claim 2.

7. A strip product comprising the titanium alloy of claim 1.

8. A strip product comprising the titanium alloy of claim 2.

* * * * *